US007267076B2

(12) United States Patent
Hones

(10) Patent No.: US 7,267,076 B2
(45) Date of Patent: Sep. 11, 2007

(54) ANT SCULPTURES

(76) Inventor: William G. Hones, 19224 des Moines Way S., Ste 100, Seattle, WA (US) 98148

( * ) Notice: Subject to any disclaimer, the term of this patent is extended or adjusted under 35 U.S.C. 154(b) by 37 days.

(21) Appl. No.: 11/252,178

(22) Filed: Oct. 17, 2005

(65) Prior Publication Data

US 2006/0082023 A1 Apr. 20, 2006

Related U.S. Application Data

(60) Provisional application No. 60/619,512, filed on Oct. 15, 2004.

(51) Int. Cl.
*B44F 7/00* (2006.01)

(52) U.S. Cl. ..... 119/6.5; 428/15

(58) Field of Classification Search ..... 119/6.5, 119/417, 421; 434/296, 297; 428/15, 13
See application file for complete search history.

(56) References Cited

U.S. PATENT DOCUMENTS 3,177,279 A * 4/1965 Bilodeau ..... 264/255
5,227,205 A * 7/1993 Dubrow et al. ..... 428/13
5,275,125 A * 1/1994 Rotramel ..... 119/416
5,359,806 A * 11/1994 Jeffery et al. ..... 43/131
5,609,632 A * 3/1997 Elgas ..... 128/898
5,803,014 A 9/1998 Guri
5,855,187 A 1/1999 Tominaga
5,881,676 A 3/1999 Brown
6,254,396 B1 * 7/2001 Stevens ..... 434/276

OTHER PUBLICATIONS

Making a Fire Ant Mount Cast by Petty,'Tunnel Vision' Jan.-Mar. 1999, University of Arkansas www.aragriculture.org/news/tvision/html/1999/j . . . Arkansas Agriculture Newsletters.
Uncle milton's Giant Ant Farm—believed prior art-Speedydog.net www.speedydog.net/prod_antf_giant.html.
Answers: Ant Mound tunnel Sculpture http://answers.google.com/answers/main?cmd+threadvi.
Written Opinion and Search Report of ISA of counterpart PCT/US05/37036 completed Dec. 22, 2006,mailed Feb. 20, 2007.

* cited by examiner

*Primary Examiner*—Rob Swiatek
(74) *Attorney, Agent, or Firm*—Robert W. J. Usher

(57) ABSTRACT

An ant sculpture is formed by removing a block of nutritious gel having with a network of ant tunnels from a formicarium container; placing the block in an p.v.c bag that serves as a release liner; and stuffing the bag containing the gel block back into the container. The tunnel network is then filled with a transparent epoxy resin which is permitted to harden in the tunnel network; the bag containing the gel body with set epoxy removed from the container and, the gel is then separated so that the hardened epoxy forms an ant sculpture replicating the network of ant tunnels. The epoxy resin is Bisphenol A epoxy resin.

19 Claims, 6 Drawing Sheets

ANT SCULPTURES

RELATED APPLICATION

Priority is claimed from my provisional application 60/619,512 filed Oct. 15, 2004, the disclosure of which is incorporated herein by reference.

FIELD OF THE INVENTION

The invention relates to ant sculptures formed by casts of ant tunnel networks.

BACKGROUND OF THE INVENTION

It is prior art to make ant sculptures by casting materials in ant tunnels. An article by Petty in "Tunnel Vision", January-March 1999 edition (www.aragriculture.org/news/tvision.html/1999/) teaches filling ant tunnels with either molten wax or lead involving the steps of locating a fire ant mound in the field; flaking off a 1-2 inch area at the top to expose five tunnels; pouring the melt into respective tunnels until filled or until a cast estimated to be of desired size is reached; permitting the melt to cool and set; carefully digging up the cast and surrounding it in a bucket of warm soapy water for at least one hour for wax, or fifteen minutes for lead and, gently washing the cast to remove the soil (and ants) from between the tunnels. Grass and other foreign material need to be removed subsequently (with pliers from lead).

Furthermore, Petty teaches that, with wax, the cast temperature must be maintained above 80 degrees to avoid brittleness and risk of damage.

Using lead requires melting the lead on site in a lidded cast iron pot using a fierce heating source such as a propane burner. Because of weight, the molten lead needs to be transferred to a smaller pot with a pouring lip or ladle, and poured carefully as a steady stream.

Clearly, the above steps are time consuming and careful handling techniques need to be performed in the field in the presence of biting ants—donning protective latex gloves lined with talc is suggested by Petty—added to the other disadvantages of either sculpture fragility (wax) or high weight and, a sculpture of somewhat unpredictable size.

Separately, casting with dental plaster has also been proposed in the prior art.

It is also widely known to keep ants in formicarium-transparent walled containers filled with transparent, (clear or colored), ant-nutritious gel medium as disclosed in U.S. Pat. No. 5,803,014 issued in 1998 to Guri, providing the distinct practical advantages that the ants do not require any other food or water and can be seen in their tunnels throughout the medium.

However, clearly, casting materials significantly above ambient temperature cannot be poured into agar gel without destroying or significantly damaging the agar gel while an attempt to use dental plaster was not successful, apparently because the plaster did not dry and harden sufficiently to avoid collapse when attempting to separate the casting from the gel.

SUMMARY OF THE INVENTION

Objects of the invention are to provide ant sculptures that can be made relatively quickly and inexpensively in the home by unskilled persons, are durable, of predetermined compact size, and of relatively low weight and yet to maintain the distinct practical advantages of using an ant nutritious medium such as agar gel.

An additional object/advantage of the invention follows from the utilization of the residual gel material remaining in the formicarium after the ants had died or interest had lapsed which would otherwise likely be discarded, adding a new dimension of interest which builds on the investment of nurturing the ants.

According to one aspect, the invention provides an ant sculpture replicating an ant tunnel network formed by filling a tunnel network of ant-tunnel gel with casting resin flowable at ambient temperature and which has hardened over time.

Preferably, the resin is epoxy resin which is preferably transparent so that the filled tunnels provide a network of light conducting pipes.

The epoxy resin is relatively safe and easily handled even by inexperienced people and can be cast successfully in the most desirable ant nutritious gel to provide durable sculptures.

Preferably, the epoxy is Bisphenol A epoxy resin.

The ant-nutritious medium is preferably in the form of a clear or tinted gel in order to allow the ants to be observed throughout the medium. Any gel material such as an agar based gel is appropriate as a tunneling medium.

The invention provides a method of making an ant sculpture replicating an ant tunnel network comprising the steps of:

providing a formicarium comprising a rigid, transparent container filled with an ant-tunneling medium such as a transparent ant nutritious agar gel formed with a network of ant tunnels, removing any tailings from an upper surface of the tunneled medium to expose tunnel entrances;

removing the tunneled medium from the container as a unitary body with a bottom, opposite the upper surface and opposite sidewalls extending between the upper and bottom surfaces and conforming to a cross-sectional shape of the container interior;

providing a bag of thin walled, flexible transparent plastic corresponding in cross-sectional shape to the interior of the container and dimensioned to received the front, rear and sidewalls of the unitary body in a sliding fit;

sliding the unitary body, bottom face leading into the bag forming an assembly;

stuffing the assembly, bottom first, back into the container so that the bag forms a release layer interposed between the unitary body and the container interior;

providing a supply of resin flowable at ambient temperature which hardens over time and pouring the flowable resin over the upper surface of the body into the tunnel entrances to fill the tunnels with the resin;

permitting the resin to set/harden in the tunnels;

removing the bag containing the ant nutritious medium containing the set/hardened resin from the container;

removing the ant nutritious medium (body) containing the hardened resin from the bag and, removing the medium from the resin network to form the ant sculpture.

The bag acts as a release layer containing the epoxy and preventing it sticking to the container.

Preferably, the container is made from transparent polystyrene, the resin is a two-part epoxy, preferably, Bisphenol A epoxy resin and the bag is vacuum formed in one piece from PVC. Although flexible, the vacuum forming provides sufficient rigidity for the bag to be self standing.

The method includes the step of mixing the two components of the resin together prior to pouring.

According to another aspect, the invention provides a kit for making an ant sculpture replicating a network of ant tunnels comprising:

a formicarium comprising a transparent container filled with a transparent, ant nutritious gel which is removable from the container as a unitary body with a network of ant tunnels and corresponding to a cross-sectional shape of the container;

a supply of a flowable resin which hardens over time;

a transparent, flexible plastic bag dimensioned to receive the unitary body when removed from the container and stuffed into the container to provide a release layer permitting removal of the bag carrying the unitary body from the container after the tunnel network has been filled with hardened resin.

The bag may receive the unitary body as a sliding fit

Preferably, the container is made from transparent polystyrene, the resin is supplied as a two-part epoxy, (active ingredient and hardener), preferably, Bisphenol A epoxy resin and the bag is vacuum molded in one piece from PVC.

BRIEF INTRODUCTION TO THE DRAWINGS

Specific embodiments of the invention will now be described with reference to the accompanying drawings in which.

Figure 7A:
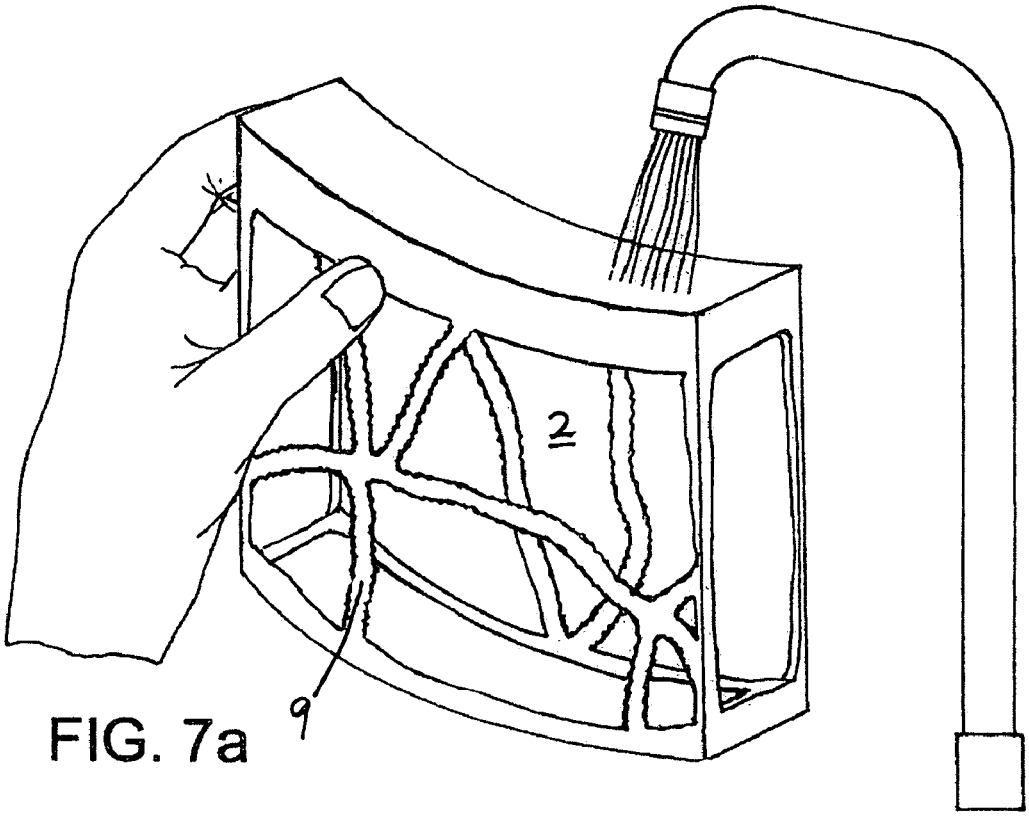
Figure 8:
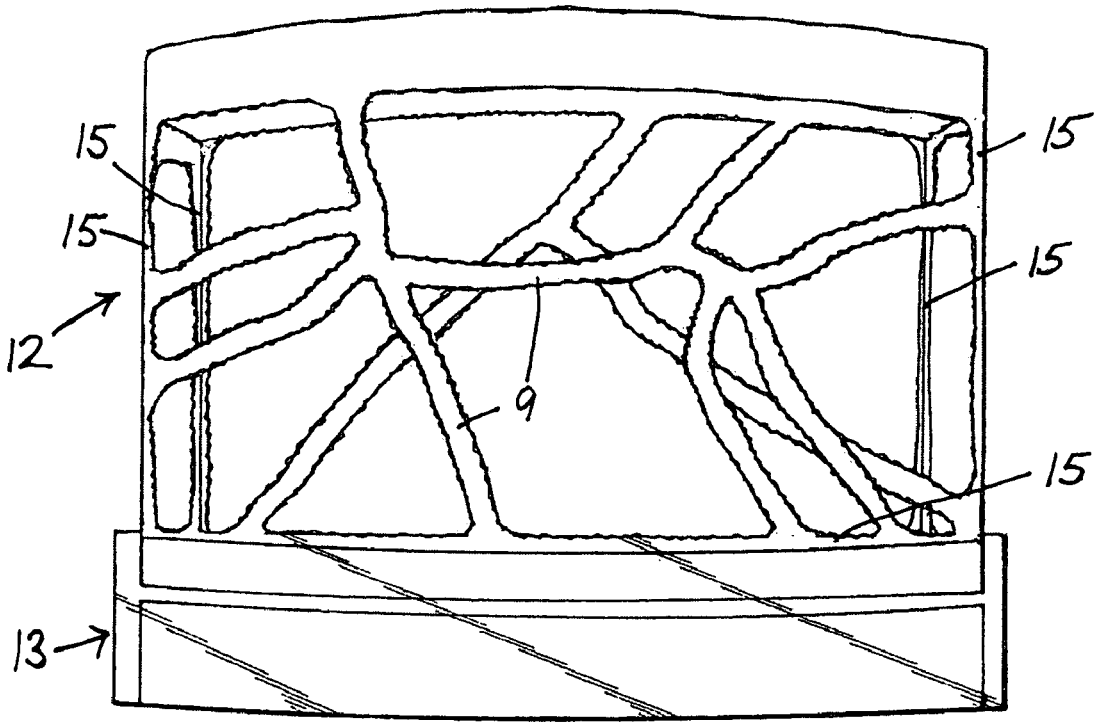
Figure 7B:
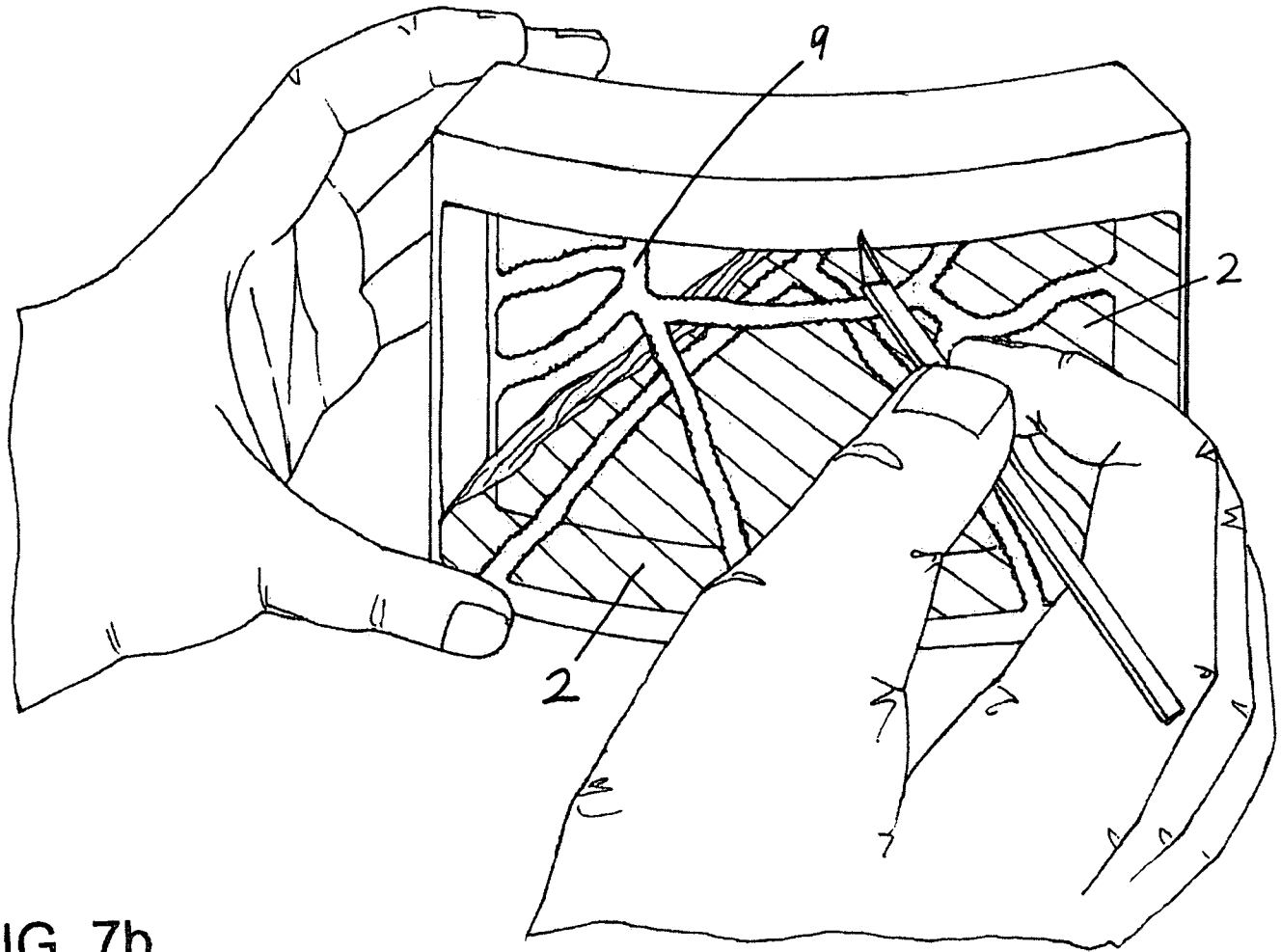
Figure 9:
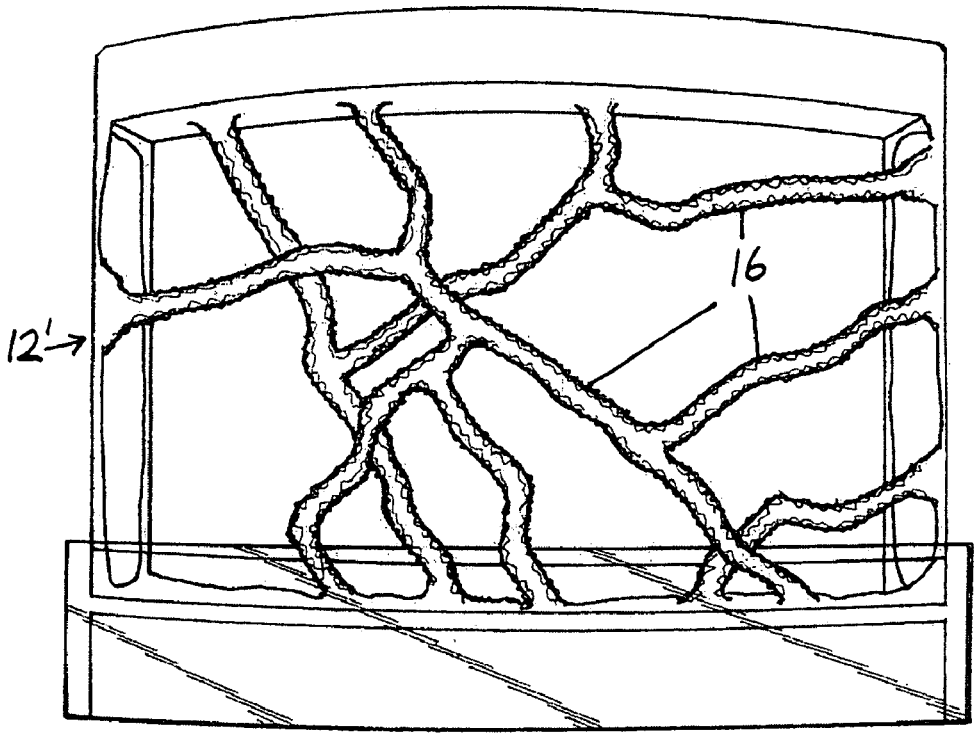
Figure 10:
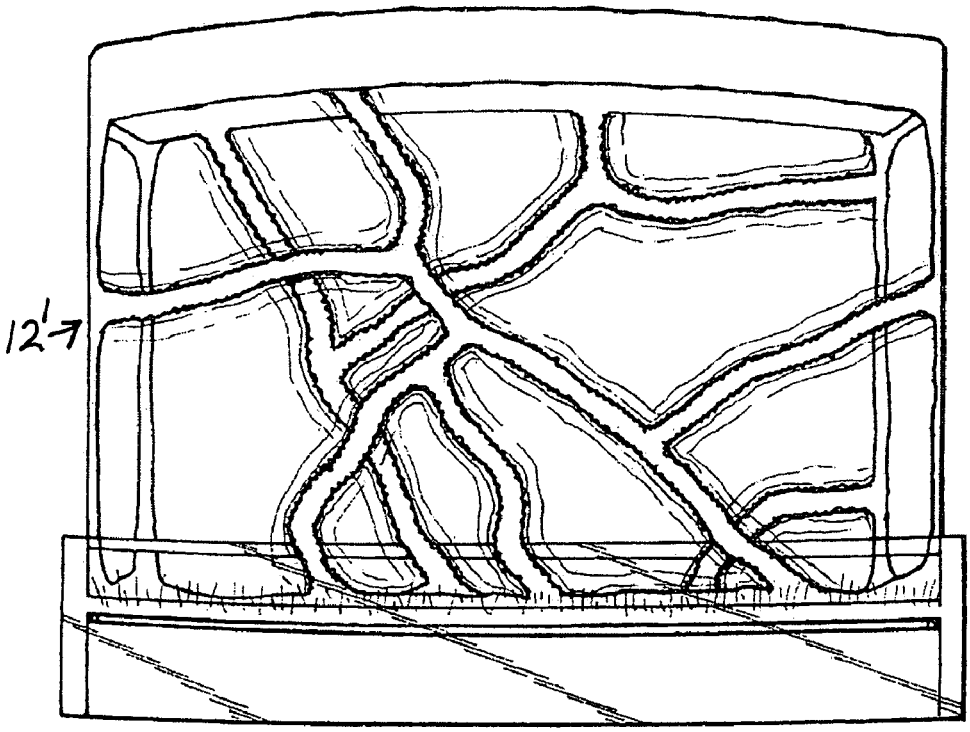

FIGS. 7*a* and 7*b* illustrate the steps of removing the gel from the set epoxy resin using water and a craft knife, respectively, to form the ant sculpture;

FIG. 8 is a front perspective view of the ant sculpture on a plexiglass stand;

FIGS. 9 and 10 are schematic front perspective views of alternative ant sculptures made from a transparent epoxy with FIG. 10 being illuminated from below

DESCRIPTION OF PARTICULAR EMBODIMENT

Figure 1:
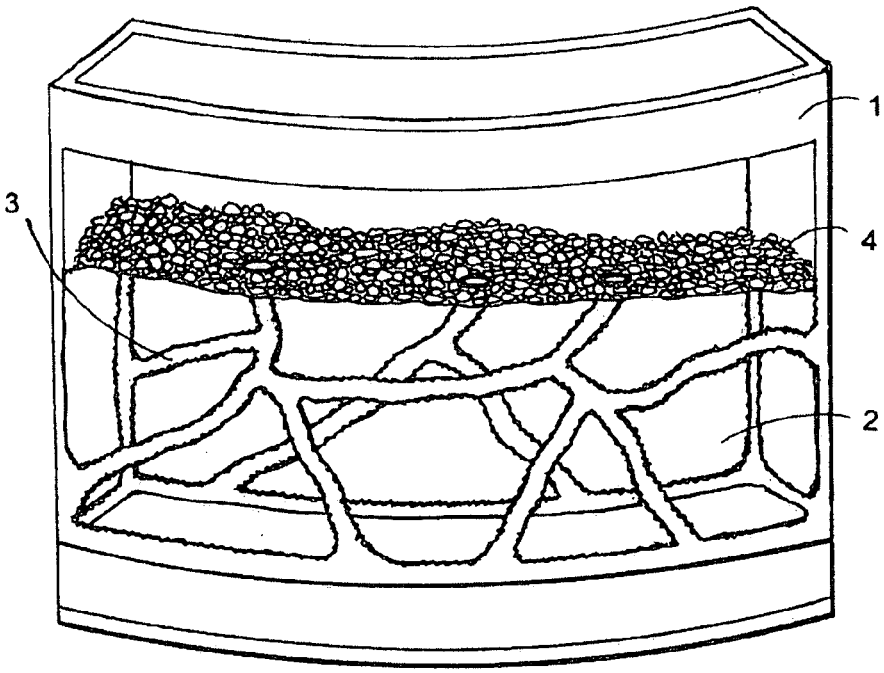
FIG. 1 is a schematic front perspective view of a transparent walled formicarium container filled with ant-nutritious gel with a network of ant tunnels and a residue of tailings on the top surface.

As shown in FIG. 1, a transparent walled formicarium comprises a concavo-convex container 1 molded in one piece from high impact transparent plastic (high impact polystyrene), filled with ant-nutritious gel 2 with a network of ant tunnels 3 and a residue of tailings 4 deposited by ants on the top surface.

Figure 2:
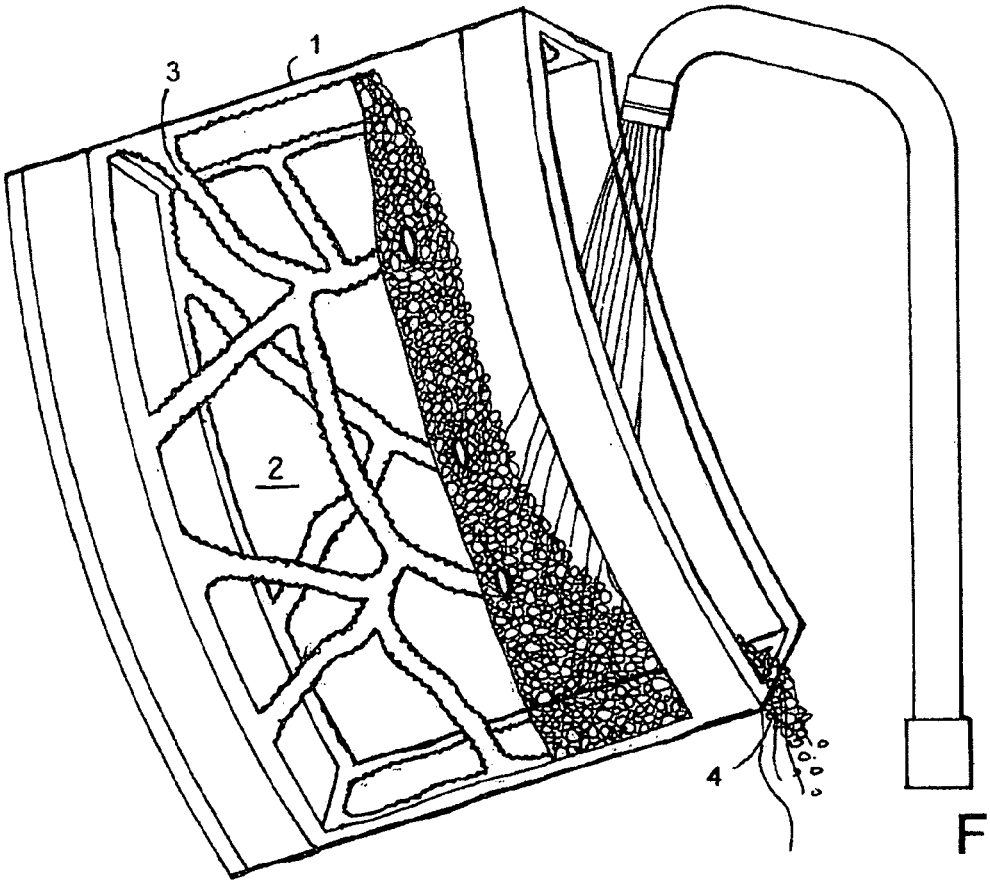
FIG. 2 is a schematic perspective view of the formicarium showing the step of sweeping the tailings and ant debris from the top surface of the gel and throughout the tunnel network by a stream of water from a faucet.
Figure 3:
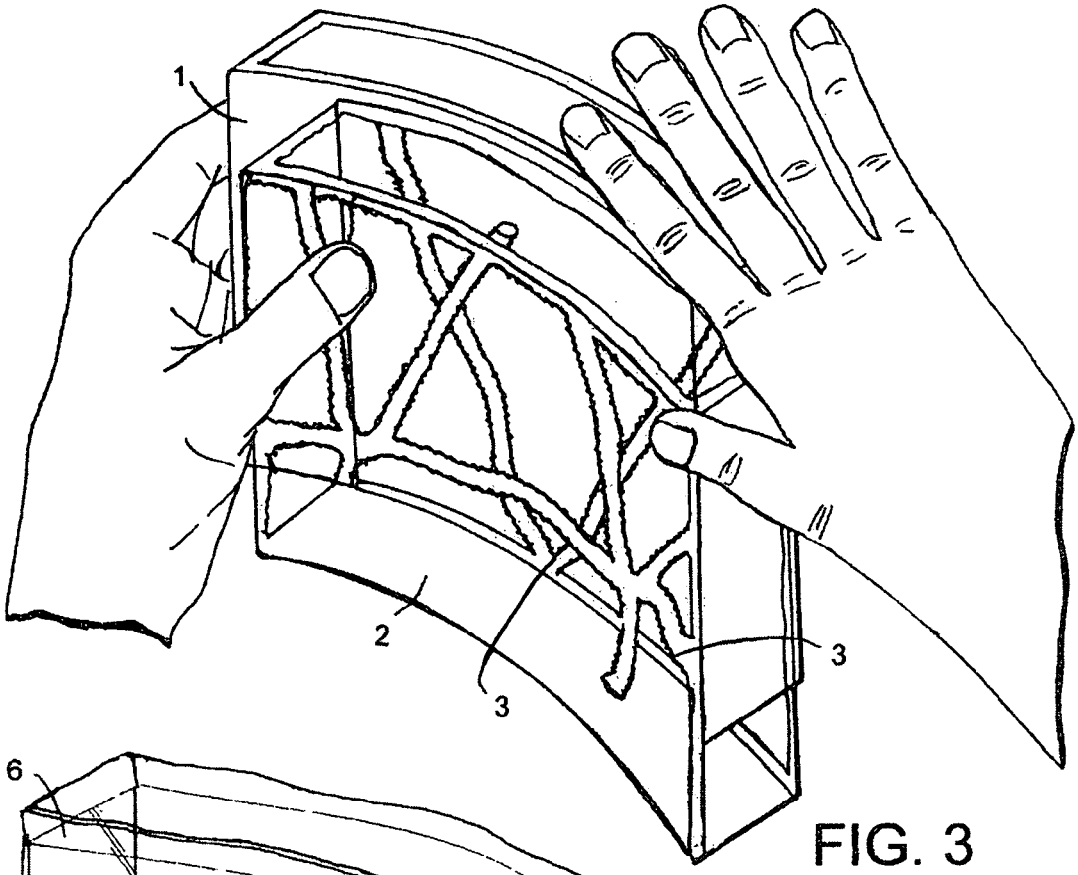
FIG. 3 is a schematic perspective view showing the step of removing the block of tunneled gel as a unitary body by shaking the inverted formicarium.

The ant sculpture is made by first removing the tailings 4 from the tunneled gel 2 and otherwise cleaned by flushing the surface with water as shown in FIG. 2. The container 1 is then inverted and the block of tunneled gel 2 removed as a unitary body by shaking the inverted formicarium, as shown in FIG. 3.

Figure 4:
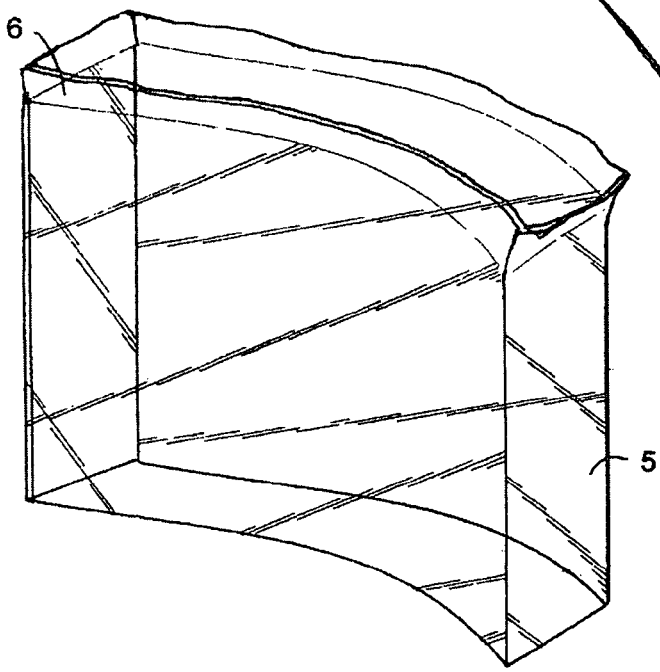
FIG. 4 is a perspective view of a PVC lining bag for containing the tunneled gel body.
Figure 5:
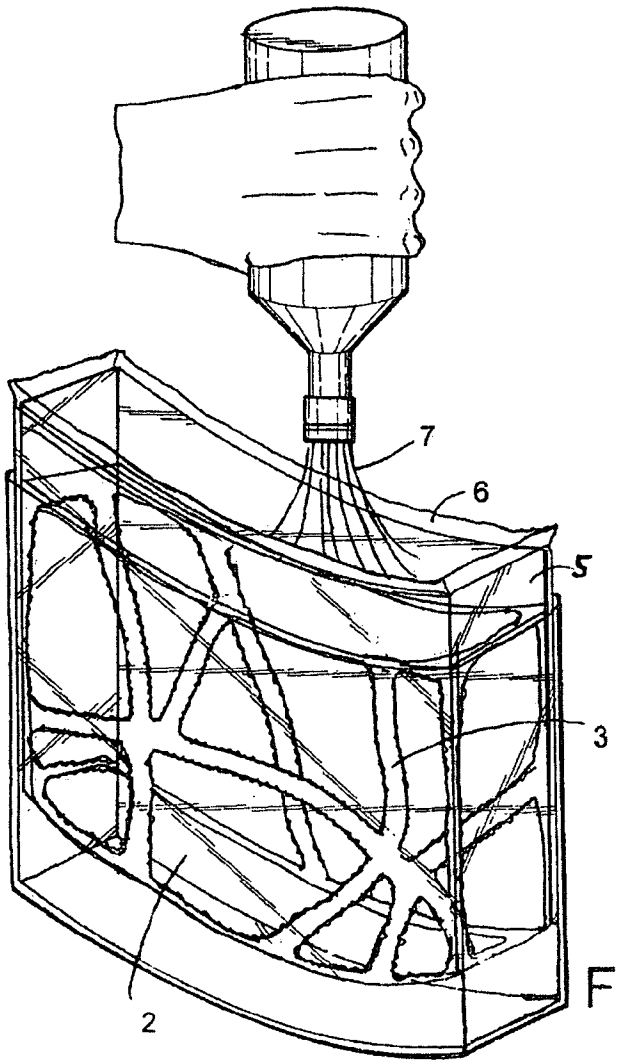
FIG. 5 is a schematic perspective view of the assembly of the tunneled gel body inserted in the bag and stuffed back into the formicarium and showing the step of filling the tunnels with white epoxy resin.

The tunneled gel block is then inserted into a transparent PVC bag 5 of FIG. 4 which has the same dimensions as the interior dimensions of the formicarium container 1, the gel in bag subassembly stuffed back into the container for support but can only be partly inserted so that the upper edges of 6 of the lining bag remain extending above the top of the rigid container, as shown in FIG. 5. Components of a suitable two part epoxy resin (Bisphenol A epoxy resin) are mixed together and the mixture 7 manually poured to fill the tunnels and layered on the surface of the gel body. Care should be taken to ensure that all the epoxy remains inside the bag which acts as a release lining permitting removal of the tunneled gel block from the high impact polystyrene container 1 without adhesive contact between the epoxy resin and the container. Although the epoxy resin can adhere to the high impact polystyrene container, it does not adhere to the PVC, enabling release therefrom.

Alternatively, the tunneled gel block may be inserted into a rigid, transparent break-apart housing for pouring the 2 part epoxy mixture.

Figure 6:
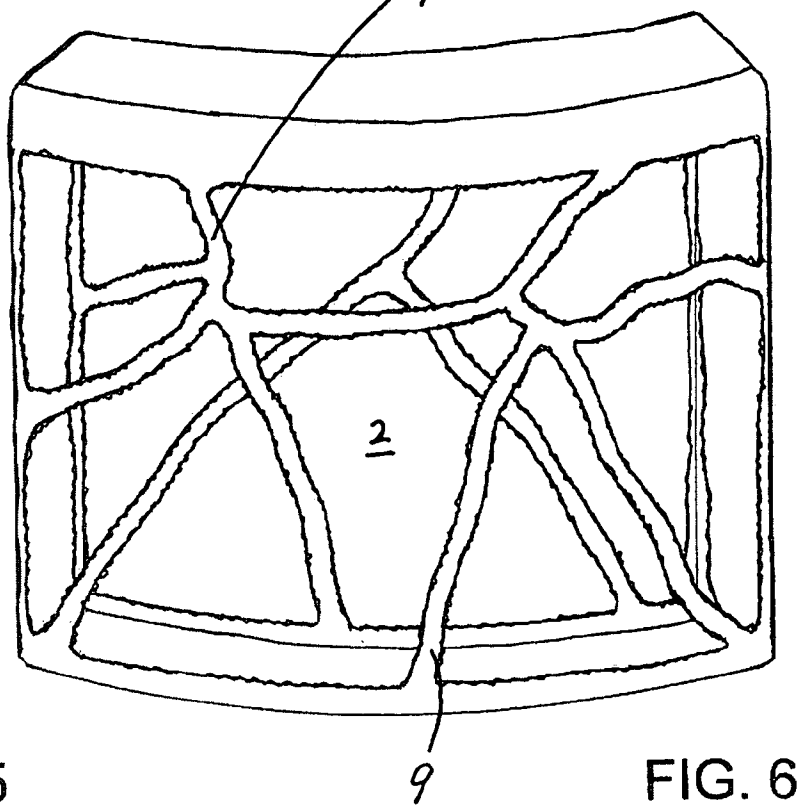
FIG. 6 is a perspective view of the tunneled gel body with tunnels filled with resin after removal from the formicarium and lining bag.

After the epoxy has hardened, (approximately 10 hours), the bag containing the gel block with epoxy filled tunnels 9 is removed from the container 1, peeled off the gel body to expose the gel containing sculpture block (FIG. 6) and, the gel containing the removed from the sculpture, using a combination of a water jet as shown in FIG. 7*a* and a craft knife as shown in FIG. 7*b*.

The resulting sculpture 12, mounted on a plexiglass stand 13, is shown in FIG. 8, and has an outer framework of epoxy limbs 15 as the ants preferentially dig tunnels at the corners formed by junctions of the sidewalls with each other and with the bases of container 1.

When using transparent epoxy, as shown schematically in FIG. 9, the slightly rough texture of the tunnel walls 16 resulting from the ants mandibles pulling away discrete small gel lumps preferentially scatters light from the surfaces of the limbs of the sculpture 12'.

When the sculpture is placed on a base with an Illuminator underneath, as shown in FIG. 10, the light from the Illuminator flows through the material to some degree as it would through light pipes while the rough surface preferentially scatters light from the limb surfaces.

The invention claimed is:

1. A three dimensional hardened ant sculpture in the form of an interconnected array of solid, resin limbs replicating an ant tunnel network formed by filling an ant tunnel network of ant-tunneled gel with casting resin flowable at ambient temperature which has hardened over time, the sculpture having rough, light scattering limb surfaces formed by a correspondingly rough texture of the tunnel walls caused by the ants' mandibles removing gel material in discrete small lumps when tunneling, the exterior of the limbs being substantially free of embedded sand or dirt as a result of being cast in the removable gel.

2. An ant sculpture according to claim 1 wherein the casting resin is an epoxy resin.

3. An ant sculpture according to claim 2 wherein the epoxy resin is transparent so that the limbs provide a network of light conducting pipes.

4. An ant sculpture according to claim 2 wherein the epoxy resin is Bisphenol A epoxy resin.

5. A method of making an ant sculpture replicating an ant tunnel network comprising the steps of:

providing a formicarium comprising a rigid, transparent container filled with a transparent, ant-nutritious, ant tunneling gel medium formed with a network of ant tunnels, removing any tailings from an upper surface of the tunneled medium to expose tunnel entrances;

removing the tunneled medium from the container as a unitary body with a bottom, opposite the upper surface and opposite sidewalls extending between the upper and bottom surfaces and conforming to a cross-sectional shape of the container interior;

providing a bag of thin walled, flexible transparent plastic corresponding in cross-sectional shape to the interior of the container and dimensioned to received the front, rear and sidewalls of the unitary body in a sliding fit;

sliding the unitary body, bottom face leading into the bag forming an assembly;

stuffing the assembly, bottom first, back into the container so that the bag forms a release layer interposed between the unitary body and the container interior;

providing a supply of casting resin flowable at ambient temperature which hardens over time and pouring the flowable resin over the upper surface of the body into the tunnel entrances to fill the tunnels with the resin;

permitting the resin to set in the tunnels;

removing the bag containing the ant nutritious medium containing the set resin from the container;

separating ant nutritious medium containing the hardened resin as a unitary body from the bag and, removing the medium from the resin network to form the ant sculpture.

6. The method of claim 5 wherein the resin is a two-part epoxy resin and comprising the step of mixing the parts together prior to pouring over the upper surface of the body.

7. The method of claim 6 wherein the epoxy resin is Bisphenol A epoxy resin.

8. The method of claim 5 wherein the container is made from high impact polystyrene, the bag has dimensions which are similar to dimensions of an interior of the container and is vacuum molded in one piece from PVC.

9. A kit for making an ant sculpture replicating a network of ant tunnels comprising:

a formicarium comprising a transparent container filled with a transparent, ant nutritious and tunneling gel which is removable from the container as a unitary body with a network of ant tunnels and corresponding to a cross-sectional shape of the container;

a supply of a flowable resin which hardens over time;

a transparent, flexible plastic bag dimensioned to receive the unitary body when removed from the container and stuffed into the container to provide a release layer permitting removal of the bag carrying the unitary body from the container after the tunnel network has been filled with hardened resin.

10. The kit of claim 9 wherein the resin is a two-part epoxy resin.

11. The kit of claim 10 wherein the epoxy resin is Bisphenol A epoxy resin.

12. The kit of claim 9 wherein the container is made from high impact polystyrene, the bag has dimensions which are similar to dimensions of an interior of the container and is vacuum molded in one piece from PVC.

13. A method of making a three dimensional ant sculpture replicating an ant tunnel network comprising the steps of:

filling an ant tunnel network of ant-tunneled gel with casting resin flowable at ambient temperature, permitting the casting resin to harden over time and removing the gel.

14. The method of claim 13 wherein the casting resin is an epoxy resin.

15. The method of claim 14 wherein the epoxy resin is transparent so as to provide a network of light conducting pipes.

16. The method of claim 15 wherein the epoxy resin is Bisphenol A epoxy resin.

17. The method of claim 15 wherein the gel is removed by water.

18. The method of claim 14 wherein the sculpture has rough, light scattering limb surfaces formed by a correspondingly rough texture of the tunnel walls caused by the ants mandibles removing gel material in discrete small lumps when tunneling.

19. The method of claim 13 wherein the gel is removed by water.

* * * * *